United States Patent [19]

Gohl

[11] Patent Number: 4,986,425

[45] Date of Patent: Jan. 22, 1991

[54] SPORTS ACCESSORY STORAGE RACK

[76] Inventor: Gary T. Gohl, 2048 Watson St., Glendale, Calif. 91201

[21] Appl. No.: 554,439

[22] Filed: Jul. 19, 1990

[51] Int. Cl.[5] ..... A47F 5/00

[52] U.S. Cl. ..... 211/4; 70/58; 211/70.2; 312/198

[58] Field of Search ..... 211/4, 70.2; 70/58, 70/62, 64; 312/198; 248/96

[56] References Cited

U.S. PATENT DOCUMENTS

| | | | |
|---|---|---|---|
| 4,666,220 | 5/1987 | Bucaille et al. | 312/198 |
| 4,690,467 | 9/1987 | Imbert | 70/58 X |
| 4,862,656 | 9/1989 | Kelly | 70/62 X |
| 4,863,019 | 9/1989 | Lewis et al. | 70/64 X |

*Primary Examiner*—Robert W. Gibson, Jr.

*Attorney, Agent, or Firm*—Roger A. Marrs

[57] ABSTRACT

A storage rack is disclosed herein for releasably holding a plurality of sport accessory items having an elongated frame with a base mounting a plurality of spaced-apart receptacles and an upper member raised from the base having a plurality of inverted bucket members coaxially disposed with respect to the receptacles. The bucket members are movably mounted on the upper member so as to move vertically towards and away from the receptacles in order to alternately capture and release a sports accessory therebetween. A yieldable biasing mechanism interconnects the bucket member to the frame for normally biasing the bucket member into the release position and a lock and latch mechanism couples the bucket member to the frame to maintain the bucket member in the capture position.

6 Claims, 2 Drawing Sheets

SPORTS ACCESSORY STORAGE RACK

BACKGROUND OF THE INVENTION

1. Field of the Invention

The present invention relates to security apparatus for use in combination with a sports accessory, such as a golfclub bag, and more particularly to a novel rack for releasably securing a plurality of golfclub bags including the golfclubs within the bag so as to prevent theft of the golfclubs.

2. Brief Description of the Prior Art

In the game of golf, it is common practice to utilize the facilities of golf courses or country clubs in which locker rooms are available for the change of clothes and for the unattended storage of golf bags containing a plurality of golfclubs. While unattended, it sometimes happens that the clubs are stolen or are otherwise removed from the golf bag so that the clubs are lost and unavailable to the owner for use during the game of golf.

Some attempts have been made to cover or otherwise hold the plurality of clubs in the bag so that removal can only be achieved by the owner. In this attempt, various types of covers have been designed to fit over the mouth of the club bag to completely enclose the golfclubs within the bag or to provide an opening for one or more shafts of the golfclubs which is large enough to accommodate one or more golfclub shafts, but not large enough to permit removal of the golfclubs, in a locked or closed configuration. Various covers are disclosed in U.S. Letters Patent Nos. 1,570,510; 1,928,922; and 1,908,998. Other attempts have been made which involved security devices requiring the inconvenience of turning the golfclubs upside down and which further require extensive modification of the conventional golf bag so as to accommodate a locking mechanism.

Still a more recent attempt to discourage or avoid unauthorized removal of golfclubs from a golf bag is disclosed in U.S. Letters Patent 4,863,019 which utilizes rigid arm members that grip one of more of the golfclub shafts and an extendable member which is hinged to a base so as to allow the arm members to swing over and away from the mouth of the golf bag.

Although the aforementioned apparatus has, to some extent, prevented theft and unauthorized removal of clubs from a bag, such mechanisms are extremely expensive and require modification of the golf bag itself in order to accommodate the securement device. Full securement is not always available inasmuch as portions of the apparatus can be removed or cut through so that full securement is not available.

Therefore, it has been a long-standing need to provide a security apparatus for a sports item, such as a golf bag including a plurality of golfclubs or in other instances, a pair of skis or the like which will fully retain or capture the accessory in a locked position subject to removal by authorized personnel. Preferably, the apparatus must accommodate a plurality of golf bags with their golfclubs and must not necessitate direct attachment or modification of the golf bag itself.

SUMMARY OF THE INVENTION

Accordingly, the above problems and difficulties are obviated by the present invention which provides a novel rack for releasably storing a plurality of sport accessories, such as a golf bag including golfclubs which comprises an elongated frame having a base with a plurality of receptacles adapted to insertably receive the bottom of a golf bag, and which further includes a raised or upper member having a movable basket or bucket member coaxially disposed with respect to the receptacle for selectively encircling and capturing the upper end of the golf bag including the plurality of golfclubs. In one form of the invention, the bucket member moves vertically and includes a biasing means normally positioning the bucket member in a lower or golf bag capturing position. Such means is yieldable so as to be raised in order to release the bag and its golfclubs so that the bag may be removed and so that another bag may be placed in the receptacle for storage. A locking means, including a key latch, is included for detachably connecting the bucket member to the frame in its bag-capturing position so that only authorized personnel can release the bucket member and remove the golf bag and clubs.

Therefore, it is among the primary objects of the present invention to provide a novel storage rack apparatus for a plurality of golf bags including their attendant golfclubs that captures the golf bag and clubs in a secure position so that neither the bag nor the clubs can be removed without authorization through the use of a locking means.

Another object of the present invention is to provide a novel storage rack for a plurality of sporting accessories, such as a golf bag with clubs having a bag-capturing position and a bag release position with biasing means normally urging the apparatus into a locked storage position.

Another object of the present invention is to provide a novel storage rack for golf bags that is susceptible for coin lock operation and which prevents the removal of clubs from the bag while the bag is in its stored position.

Yet another object of the present invention is to provide a novel storage rack for a golf bag, including golfclubs, as an item representing a sports accessory so that the apparatus does not harm, mar or otherwise damage the golf bag or clubs per se.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

DESCRIPTION OF THE PREFERRED EMBODIMENT

Figure 1:
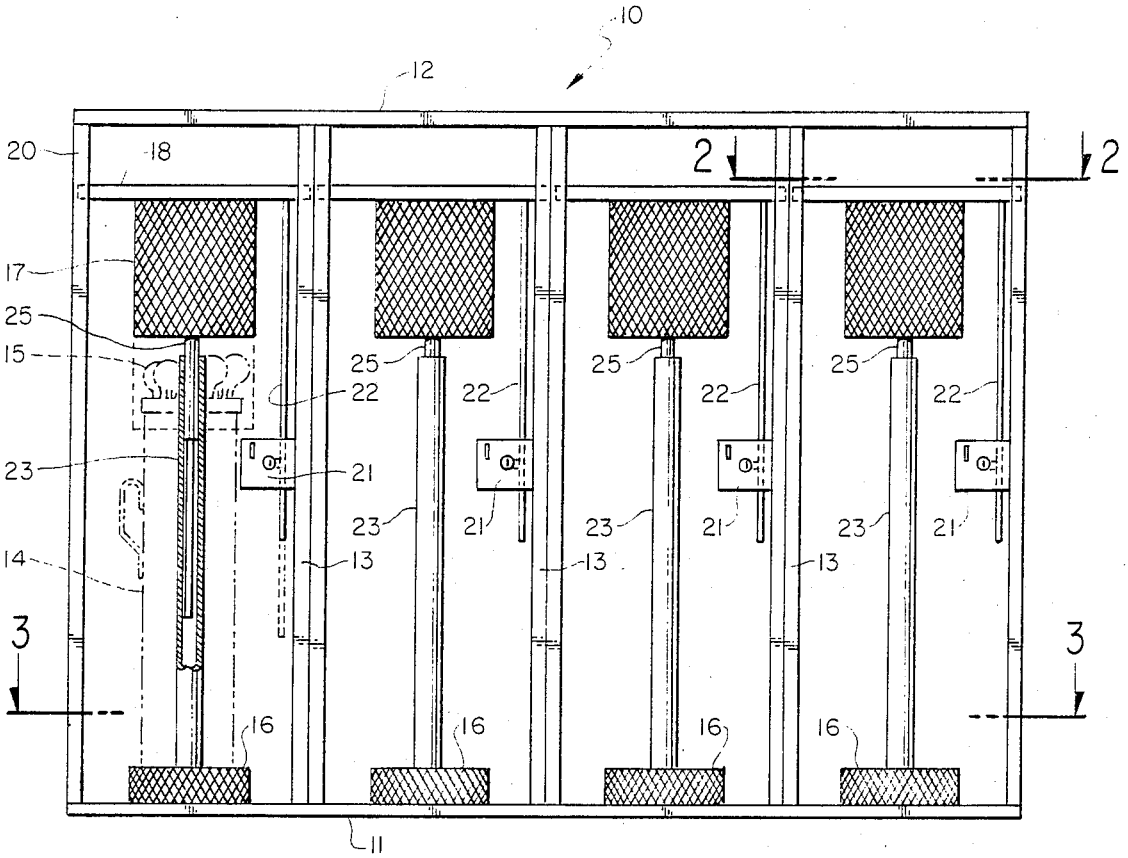
FIG. 1 is a front elevational view of the novel storage rack incorporating the present invention for releasably capturing a golf bag including golfclubs.

Referring to FIG. 1, the novel storage rack of the present invention is indicated in the general direction of arrow 10 which is illustrated as having a plurality of storage stations carried on a frame having a base 11 and a top member 12. A plurality of stanchions or uprights 13 connect the member 12 with the base 11 whereby the frame is divided into a plurality of stations each of which is to support and store a sports accessory or article, such as a golf bag with a plurality of golfclubs. For example, FIG. 1 shows a golf bag indicated by numeral 14, which contains a plurality of golfclubs 15. The lower portion or bottom of the golfclub bag 14 is insertably received within the confines of an open receptacle 16 carried on the base 11. The diameter of the receptacle is of sufficient diameter to easily receive insertion of the lower portion of the bag 14. Arranged in movable spaced-apart relationship, there is provided a basket or bucket member 17 having an open or release position shown in solid lines and a capture or storage position shown in broken lines. When in the capture position, the bucket member 17 encloses the upper portion or end of the golf bag 14, including the plurality of clubs 15. When in the capture position, the golf bag cannot be removed from its confinement between the bucket member 17 and the receptacle 16. Also, the diameter of the bucket member 17 is such that it will easily pass over the upper end of the golf bag without causing damage or without necessitating a connection therewith. The bucket member 17 downwardly depends from a guide 18 having its opposite ends disposed in tracks provided in the rails 13 and 20 respectively.

The bucket member 17 is held in its capture position, as shown in broken lines, by a lock means 21 requiring a key and/or a coin to set or unlock. The coin or lock mechanism is of conventional design similar to the key and coin operated locks used in airport, train and bus depots for storage compartments. However, in the present situation, the guide member 18 includes a downwardly depending rod 22 which passes through the lock mechanism 21 and serves as a latch-engaging member for holding the bucket member in its storage position. Upon release, the rod 22 travels upward so that the bucket member can be removed from the top of the golf bag whereby the golf bag has been released.

Means are provided for biasing the bucket member 17 to its uppermost position that includes a shock-absorbing or damper means taking the form of a piston and cylinder assembly contained within an operative sleeve and designated in general by the numeral 23.

Figure 2:
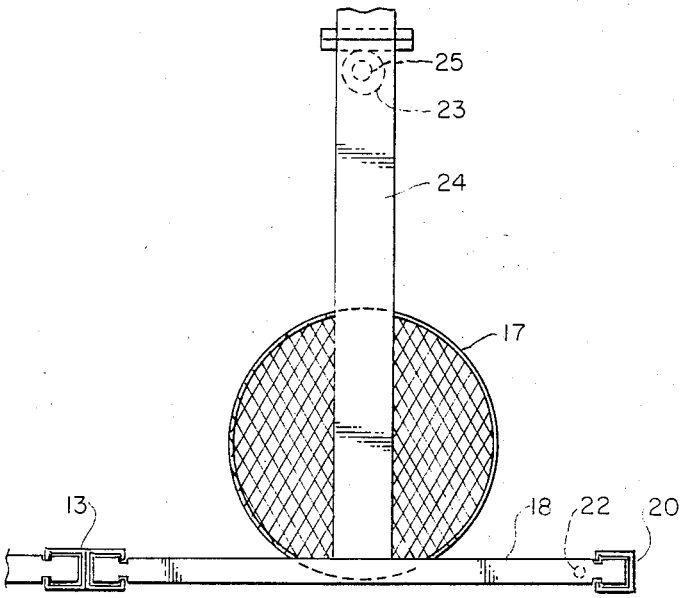
FIG. 2 is a fragmentary view taken in section along lines 2—2 of the apparatus shown in FIG. 1.

Referring now in detail to FIG. 2, it can be seen that the guide bar or rod 18 is coupled to a tie bar 24 to which the basket or bucket member 17 is also attached The locking rod is shown by numeral 22, while the biasing means is indicated by numeral 23. Preferably, both the receptacle 16 and the bucket member 17 are composed of a wide mesh material which will restrict cutting or disassembly by unauthorized persons. Each of the respective bucket members will move between the capture and the storage position as well as the release position independent of bucket members associated with other stations in the rack.

Figure 3:
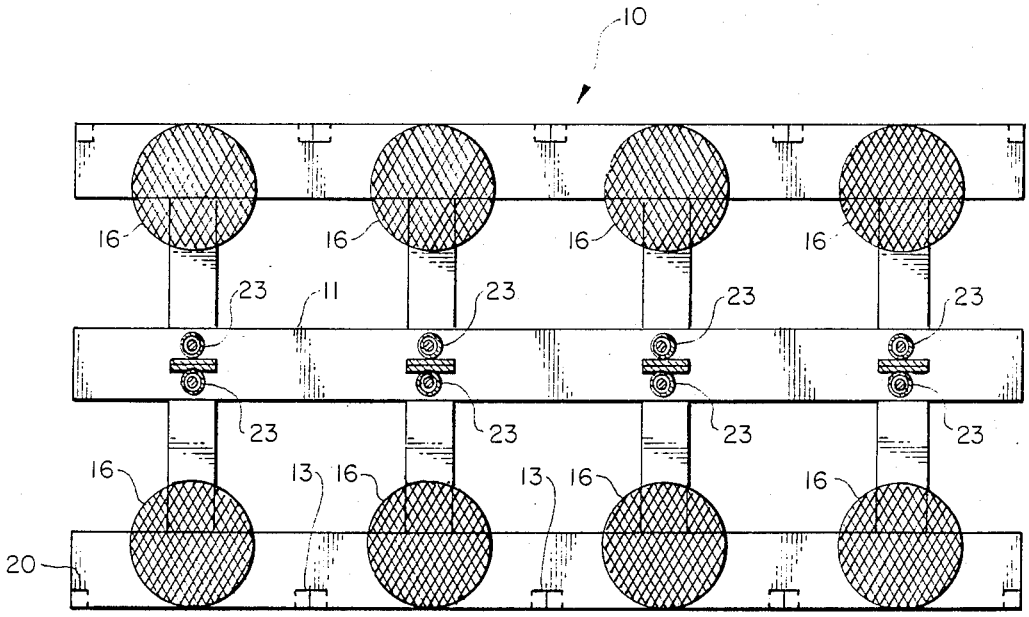
FIG. 3 is a top plan view of the storage apparatus shown in FIG. 1.

Referring now in detail to FIG. 3, it can be seen that a plurality of receptacles are disposed along the base 11 and that the base forms the lower part of the overall frame so that the receptacles and the bucket members may be held in coaxial relationship about a common axis.

Figure 4:
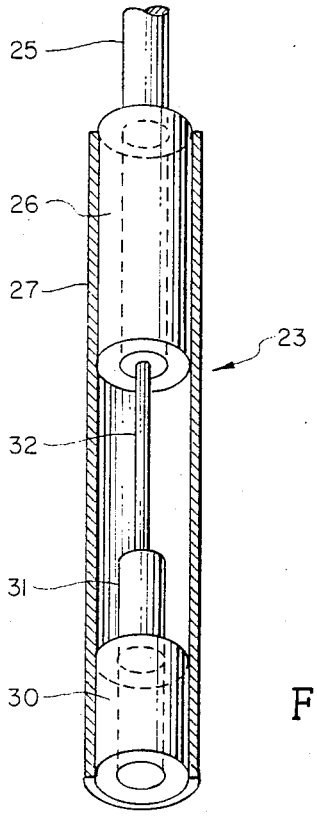
FIG. 4 is an enlarged sectional view showing a hydraulic biasing means employed at each one of the storage stations shown in the storage rack apparatus.

Referring now in detail to FIG. 4, the self-biasing mechanism or means of the present invention is shown in greater detail wherein one end of a rod 25 is attached to the tie bar 24, as shown in FIG. 2, while the opposite end is carried within a bearing member 26 held within a sleeve 27. Spaced apart from the bearing 26 is another bearing 30 also carried on the inside of the sleeve 27. The bearing or mounting member 30 carries one end of a piston and cylinder assemblage wherein numeral 31 indicates the cylinder and numeral 32 indicates the piston. One end of the piston considering it to be an operative end, is fastened to the rod 25. The cylinder 31 contains a biasing means either taking the form of a pressurized hydraulic fluid or a coiled helical spring which forcibly urges the rod 32 and rod 25 upwardly to place the bucket member 17 in the positions shown in FIG. 1 by solid lines. The bias is normally overcome by manual or other pressure placed on the guide bar or bucket member 17 so that downward disposition of the bucket member over the golfclubs and top of the golf bag can be achieved so that the dotted line position shown in FIG. 1 has been attained At this time, the rod 22 will be engaged by the locking mechanism 21 and held in this position during the storage time.

In view of the foregoing, it can be seen that the novel storage rack of the present invention provides a means for storing a sports accessory such as a golf bag, including its clubs, for a period of time and without engaging, damaging or otherwise marring the golf bag itself. Complete security is attained because of the locking mechanism and the mesh construction of the pair of bag retainers taking the form of the receptacle 16 and the bucket member 17.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A security storage rack for use in combination with a golfclub bag exposing a plurality of golfclubs, said rack comprising:

as elongated frame having a base and an upper member arranged in fixed spaced-apart relationship;

a plurality of receptacles secured to said base in fixed spaced-apart relationship, each of said receptacles adapted to insertably receive the bottom portion of said golf bag;

a plurality of cylindrical bucket members movably carried on said frame adjacent to said upper member and each bucket being coaxially disposed with respect to each one of said receptacles and being adapted to insertably cover the upper portion of said golf bag including said plurality of golfclubs in a capture position;

means operably carried on said frame normally biasing said bucket member to a raised release position.

2. The invention as defined in Claim 1 including locking means operably connected between said bucket members and said frame for releasably securing said bucket members to said frame in said capture position.

3. The invention as defined in Claim 2 wherein:

said biasing means includes a piston and cylinder assemblage operably coupled between said bucket member and said frame.

4. The invention as defined in Claim 3 wherein:

said lock means includes an element fixed to said bucket member and a lock mechanism slidably receiving said element and operative to latch therewith to maintain said bucket member in said capture position against the bias of said biasing means.

5. The invention as defined in Claim 4 including:

guide and carriage means movably mounting each of said bucket member to said frame.

6. The invention as defined in Claim 5 wherein:

said guide and carriage means includes a cross bar and a tie bar coupled to each bucket member and each cross bar slides in relation to support stanchions extending between said base and said upper member.

* * * * *